US011498091B2

(12) United States Patent
MacIndoe et al.

(10) Patent No.: US 11,498,091 B2
(45) **Date of Patent: *Nov. 15, 2022**

(54) PIEZOELECTRIC JETTING SYSTEM WITH QUICK RELEASE JETTING VALVE

(71) Applicant: NORDSON CORPORATION, Westlake, OH (US)

(72) Inventors: William MacIndoe, Exeter, RI (US); John D. Jones, Cranston, RI (US); Bryan Teece, Fall River, MA (US)

(73) Assignee: Nordson Corporation, Westlake, OH (US)

( * ) Notice: Subject to any disclaimer, the term of this patent is extended or adjusted under 35 U.S.C. 154(b) by 171 days.

This patent is subject to a terminal disclaimer.

(21) Appl. No.: 16/027,314

(22) Filed: Jul. 4, 2018

(65) Prior Publication Data

US 2018/0311697 A1 Nov. 1, 2018

Related U.S. Application Data

(63) Continuation of application No. 15/153,996, filed on May 13, 2016, now Pat. No. 10,022,744.
(Continued)

(51) Int. Cl.
*B05C 5/02* (2006.01)
*B05C 11/10* (2006.01)
(Continued)

(52) U.S. Cl.
CPC ..... *B05C 5/0225* (2013.01); *B05B 15/65* (2018.02); *B05C 11/1034* (2013.01); *B05B 1/3046* (2013.01); *B05C 5/001* (2013.01)

(58) Field of Classification Search
CPC .. B05C 5/0225; B05C 11/1034; B05B 15/065
(Continued)

(56) References Cited

U.S. PATENT DOCUMENTS 4,793,517 A * 12/1988 Washut ..... A47K 5/1211 222/129
4,880,145 A * 11/1989 McManus ..... A47K 3/281 222/192
(Continued)

FOREIGN PATENT DOCUMENTS

CN 1570371 A 1/2005
CN 101725444 A 6/2010
(Continued)

OTHER PUBLICATIONS

European Application No. 16170016.6: Extended European Search Report dated Oct. 27, 2016, 8 pages.
(Continued)

*Primary Examiner* — Chee-Chong Lee
(74) *Attorney, Agent, or Firm* — BakerHostetler

(57) ABSTRACT

A fluid dispenser includes a dispenser body including an actuator, a fluid body housing, and a fluid body. The fluid body housing is coupled to the dispenser body at one end and releasably coupled to the dispenser body at another end, such that the fluid body housing is pivotable between a first position in which the fluid body housing is coupled to the dispenser body at both ends and a second position in which the fluid body housing is decoupled from the dispenser body at the other end. The fluid body includes a fluid inlet and a dispensing valve. The fluid body is at least partly retained in the fluid body housing when the fluid body housing is in the first position and is removable from the fluid body housing when the fluid body housing is in the second position.

17 Claims, 9 Drawing Sheets

Related U.S. Application Data

(60) Provisional application No. 62/165,245, filed on May 22, 2015.

(51) Int. Cl.
*B05B 15/65* (2018.01)
*B05B 1/30* (2006.01)
*B05C 5/00* (2006.01)

(58) Field of Classification Search
USPC ..... 239/102.2
See application file for complete search history.

(56) References Cited

U.S. PATENT DOCUMENTS

| | | | | |
|---|---|---|---|---|
| 4,886,192 | A * | 12/1989 | Cassia | A47K 5/1209 222/181.2 |
| 5,033,657 | A * | 7/1991 | Whittington | A47K 5/1202 222/181.2 |
| 5,094,398 | A | 3/1992 | Jeter et al. | |
| 5,183,182 | A * | 2/1993 | Comstock | A47K 5/12 222/129 |
| 6,152,386 | A | 11/2000 | Bullock et al. | |
| 6,298,829 | B1 | 10/2001 | Welch | |
| 7,399,361 | B2 | 7/2008 | De et al. | |
| 8,827,116 | B1 * | 9/2014 | Hamilton | A47K 5/1202 222/180 |
| 9,429,368 | B2 | 8/2016 | Hong et al. | |
| 9,453,389 | B2 | 9/2016 | Anderson et al. | |
| 9,457,935 | B2 | 10/2016 | Fliess et al. | |
| 9,677,558 | B2 | 6/2017 | Van Himme et al. | |
| 2004/0124251 | A1 | 7/2004 | Gressett et al. | |
| 2005/0274317 | A1 | 12/2005 | De et al. | |
| 2006/0243740 | A1 * | 11/2006 | Reynolds | A47K 5/1208 222/52 |
| 2009/0101669 | A1 | 4/2009 | Hassler et al. | |
| 2009/0167818 | A1 | 7/2009 | Morita | |
| 2010/0090035 | A1 | 4/2010 | Bertini et al. | |
| 2011/0006832 | A1 | 1/2011 | Land et al. | |
| 2013/0300748 | A1 | 11/2013 | Yaeda et al. | |
| 2015/0274371 | A1 | 10/2015 | Fliess et al. | |
| 2015/0300748 | A1 | 10/2015 | Hong et al. | |

FOREIGN PATENT DOCUMENTS

| | | | |
|---|---|---|---|
| CN | 103328762 | A | 9/2013 |
| CN | 103717894 | A | 4/2014 |
| DE | 4325143 | C1 | 12/1994 |
| DE | 102012109123 | A1 | 3/2014 |
| EP | 2561932 | A2 | 2/2013 |
| JP | 2009-154123 | A | 7/2009 |
| JP | 2009-219993 | A | 10/2009 |
| JP | 2011-230122 | A | 11/2011 |
| JP | 2013-046906 | A | 3/2013 |
| KR | 10-2013-0096739 | A | 8/2013 |
| KR | 10-1462262 | B1 | 11/2014 |
| WO | 95/03894 | A1 | 2/1995 |
| WO | 2014/048643 | A1 | 4/2014 |

OTHER PUBLICATIONS

English Translation of CN Office Action dated Aug. 30, 2019 for CN Application No. 201610343831.

* cited by examiner

PIEZOELECTRIC JETTING SYSTEM WITH QUICK RELEASE JETTING VALVE

CROSS-REFERENCE TO RELATED APPLICATIONS

This application is a continuation of U.S. patent application Ser. No. 15/153,996, filed May 13, 2016, and published as U.S. Patent App. Pub. No. 2016/0339470 on Nov. 24, 2016, which is claims the benefit of U.S. Provisional Patent App. No. 62/165,245, filed May 22, 2015, the entire contents of which are incorporated herein by reference

TECHNICAL FIELD

The present invention generally relates to non-contact, jetting dispensers for depositing small droplets of a viscous fluid onto a substrate, and more specifically, to dispensers of this type that are actuated by one or more piezoelectric elements.

BACKGROUND

Non-contact viscous material dispensers are often used to apply minute amounts of viscous materials, e.g., those with a viscosity exceeding fifty centipoise, onto substrates. For example, non-contact viscous material dispensers are used to apply various viscous materials onto electronic substrates like printed circuit boards. Viscous materials applied to electronic substrates include, by way of example and not by limitation, general purpose adhesives, ultraviolet curable adhesives, solder paste, solder flux, solder mask, thermal grease, lid sealant, oil, encapsulants, potting compounds, epoxies, die attach fluids, silicones, RTV, and cyanoacrylates.

Specific applications abound for dispensing viscous materials from a non-contact jetting dispenser onto a substrate. In semiconductor package assembly, applications exist for underfilling, solder ball reinforcement in ball grid arrays, dam and fill operations, chip encapsulation, underfilling chip scale packages, cavity fill dispensing, die attach dispensing, lid seal dispensing, no flow underfilling, flux jetting, and dispensing thermal compounds, among other uses. For surface-mount technology (SMT) printed circuit board (PCB) production, surface mount adhesives, solder paste, conductive adhesives, and solder mask materials may be dispensed from non-contact dispensers, as well as selective flux jetting. Conformal coatings may also be applied selectively using a non-contact dispenser. Generally, the cured viscous materials protect printed circuit boards and mounted devices thereupon from harm originating from environmental stresses like moisture, fungus, dust, corrosion, and abrasion. The cured viscous materials may also preserve electrical and/or heat conduction properties on specific uncoated areas. Applications also exist in the disk drive industry, in life sciences applications for medical electronics, and in general industrial applications for bonding, sealing, forming gaskets, painting, and lubrication.

Jetting dispensers generally may have pneumatic or electric actuators for moving a shaft or tappet repeatedly toward a seat while jetting a droplet of viscous material from an outlet orifice of the dispenser. The electrically actuated jetting dispensers can, more specifically, use a piezoelectric actuator.

The ability to clean a jetting dispenser valve is important to valve performance. In order to achieve proper cleaning, the fluid path to and within the valve should be easily accessible. Many jetting dispenser designs still do not have adequate access to properly clean all required surfaces. Some materials, such as ultraviolet light curable materials, will cure in the fluid path due to heat applied by a heating element associated with the dispenser. Often, the user must disassemble the heating element in some fashion to gain access for cleaning purposes. This requires time and additional tools.

For at least these reasons, it would be desirable to provide a jetting system and method that addresses these and other issues.

SUMMARY

The invention generally provides a jetting dispenser comprising an actuator housing, an actuator, a fluid body housing, and a fluid body. The actuator is located in the actuator housing and the fluid body housing is capable of being coupled to and decoupled from the actuator housing. The fluid body is coupled to the fluid body housing and includes a fluid inlet in communication with a fluid bore. The fluid body further includes a jetting valve having a movable shaft operatively coupled with the actuator when the fluid body housing is coupled to the actuator housing. The shaft is moved by the actuator to jet an amount of fluid from the fluid bore. The fluid body is capable of being removed from the fluid body housing when the fluid body housing is decoupled from the actuator housing. This allows for easy cleaning and/or replacement of the jetting valve and/or the fluid body.

In another aspect, the actuator may further comprise a piezoelectric unit that lengthens by a first distance in response to an applied voltage, and an amplifier operatively coupled to the piezoelectric unit. The fluid body housing may be coupled to the actuator housing with a hinge, and the fluid body housing may be pivoted between a position in which the fluid body housing is coupled to the actuator housing and a position in which the fluid body housing is decoupled from the actuator housing. In this manner, the fluid body housing may be easily moved between the coupled and decoupled conditions without having to completely disconnect the fluid body housing from the actuator housing. However, the fluid body housing may be coupled to the actuator housing in any suitable manner, including any manners that would completely disconnect the fluid body housing from the actuator housing.

In another aspect, the jetting dispenser may be coupled to the actuator housing with a rotating connector. The fluid body housing may further comprise a hook-shaped flange with which the rotating connector may engage to couple the actuator housing with the fluid body housing. Further, a connector housing may be rigidly affixed to the actuator housing, wherein a rotating shaft includes the rotating connector and is situated within the connector housing.

In yet another aspect, the jetting dispenser may be coupled to the actuator with a movable pin. The movable pin may couple the fluid body housing and the actuator housing by moving within a slot in the fluid body housing. Further, a connector housing may be rigidly affixed to the actuator housing and may include a spring-biasing element. The movable pin may be moved against the spring-biasing element toward the actuator housing to couple or decouple the fluid body housing and the actuator housing.

In another aspect, the actuator housing may comprise a bore and the fluid body may comprise a tappet assembly including the jetting valve. The tappet assembly may be retained in the bore of the actuator housing when the actuator housing and the fluid body housing are coupled. Further, the tappet assembly may be removable from the fluid body.

In yet another aspect, the fluid body housing may be configured with a T-shaped groove to provide a path for fluid leakage.

Various additional features and advantages of the invention will become more apparent to those of ordinary skill in the art upon review of the following detailed description of the illustrative embodiments taken in conjunction with the accompanying drawings.

DETAILED DESCRIPTION

Figure 1:
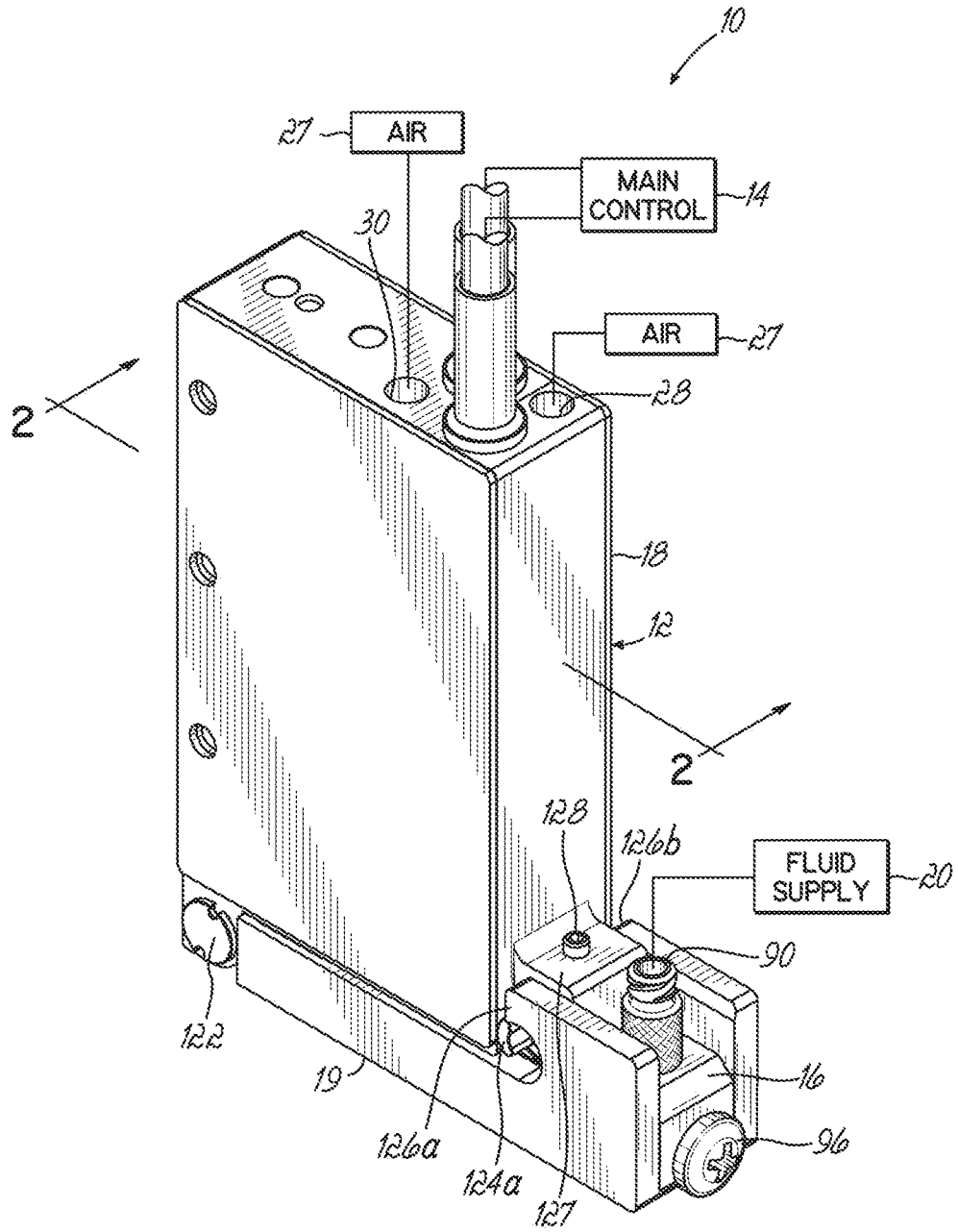
FIG. 1 is a perspective view of a jetting dispenser system according to an illustrative embodiment of the invention.

Referring to FIGS. 1 through 4, a jetting system 10 in accordance with an embodiment of the invention generally comprises a jetting dispenser 12 coupled with a main electronic control 14. The jetting dispenser 12 includes a fluid body 16 coupled to an actuator housing 18. More specifically, the fluid body 16 is held within a fluid body housing 19, which may include one or more heaters (not shown), depending on the needs of the application. The fluid body 16 receives fluid under pressure from a suitable fluid supply 20, such as a syringe barrel (not shown). A tappet or valve assembly 22 is coupled to the housing 18 and extends into the fluid body 16. A mechanical amplifier (e.g., a lever 24) is coupled between a piezoelectric actuator 26 and the tappet or valve assembly 22, as will be described further below.

Figure 2:
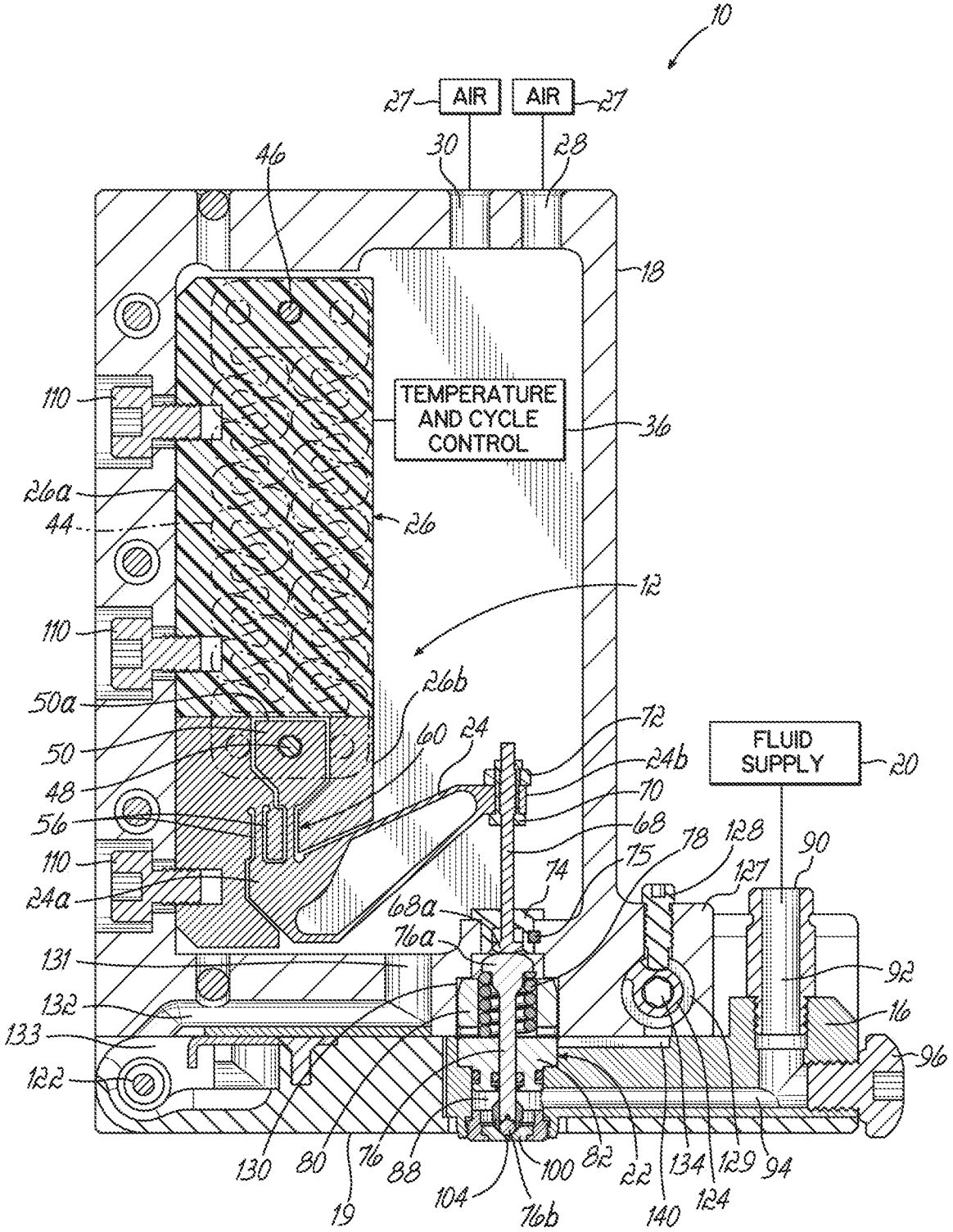
FIG. 2 is a cross sectional view taken along line 2-2 of FIG. 1.

For purposes of cooling the piezoelectric actuator 26, air may be introduced from a source 27 into an inlet port 28 and out from an exhaust port 30. Alternatively, depending on the cooling needs, both of the ports 28, 30 may receive cooling air from the source 27 as shown in FIG. 2. In such a case, one or more other exhaust ports (not shown) would be provided in the housing 18. A temperature and cycle control 36 is provided for cycling the actuator 26 during a jetting operation, and for controlling one or more heaters (not shown) carried by the dispenser 12 for maintaining the dispensed fluids to a required temperature. As another option, this control 36, or another control, may control the cooling needs of the actuator 26 in a closed loop manner. As further shown in FIG. 4, the piezoelectric actuator 26 further comprises a stack 40 of piezoelectric elements. This stack 40 is maintained in compression by respective flat, compression spring elements 42, 44 coupled on opposite sides of the stack 40. More specifically, upper and lower pins 46, 48 are provided and hold the flat spring elements 42, 44 to one another with the stack 40 of piezoelectric elements therebetween. The upper pin 46 is held within an upper actuator portion 26*a* of the actuator 26, while a lower pin 48 directly or indirectly engages a lower end of the stack 40. The upper actuator portion 26*a* securely contains the stack 40 of piezoelectric elements so that the stack 40 is stabilized against any sideward motion. In this embodiment, the lower pin 48 is coupled to a lower actuator portion 26*b* and, more specifically, to a mechanical armature 50 (FIG. 2).

An upper surface 50*a* of the mechanical armature 50 bears against the lower end of the piezoelectric stack 40. The spring elements 42, 44 are stretched between the pins 46, 48 such that the springs 42, 44 apply constant compression to the stack 40 as shown by the arrows 53 in FIG. 4. The flat spring elements 42, 44 may, more specifically, be formed from a wire EDM process. The upper end of the piezoelectric element stack 40 is retained against an internal surface of the upper actuator portion 26*a*. The upper pin 46 is therefore stationary while the lower pin 48 floats or moves with the spring elements 42, 44 and with the mechanical armature 50 as will be described.

When voltage is applied to the piezoelectric stack 40, the stack 40 expands or lengthens and this moves the armature 50 downward against the force of the spring elements 42, 44. The stack 40 will change length proportional to the amount of applied voltage.

As further shown in FIG. 2, the mechanical armature 50 is operatively coupled to a mechanical amplifier which, in this illustrative embodiment, is formed as the lever 24 coupled to the armature 50 generally near a first end 24*a* and coupled to a push rod 68 at a second end 24*b*. The lever 24 may be integrally formed from the lower actuator portion 26*b* through, for example, an EDM process that also forms a series of slots 56 between the mechanical armature 50 and the lever 24. As will be further discussed below, the lever 24 or other mechanical amplifier amplifies the distance that the stack 40 expands or lengthens by a desired amount. For example, in this embodiment, downward movement of the stack 40 and the mechanical armature 50 is amplified by about eight times at the second end 24*b* of the lever 24.

Now referring more specifically to FIGS. 2, 2A, 2B and 5, a flexural portion 60 couples the lever 24 to the mechanical armature 50. As shown best in FIG. 5, the lever 24 pivots about a pivot point 62 that is approximately at the same horizontal level as the second end 24*b* of the lever 24. This position of the pivot point 62 serves to minimize the effect of the arc through which the lever 24 rotates. The series of slots 56 is formed in the lower actuator portion 26*b* form the flexural portion 60. When the piezoelectric stack 40 lengthens under the application of a voltage by the main control 14 as shown by the arrow 66 in FIG. 5, the lever 24 rotates clockwise generally about the pivot point 62 as the stack 40 pushes downward on the mechanical armature 50. The slight rotation of the lever 24 takes place against a resilient bias applied by the flexural portion 60. As the second end 24*b* is rotating slightly clockwise about the pivot point 62, it moves downward and likewise moves an attached push rod 68 downward (FIG. 2) as indicated by the arrow 67 in FIG. 5.

Figure 2A:
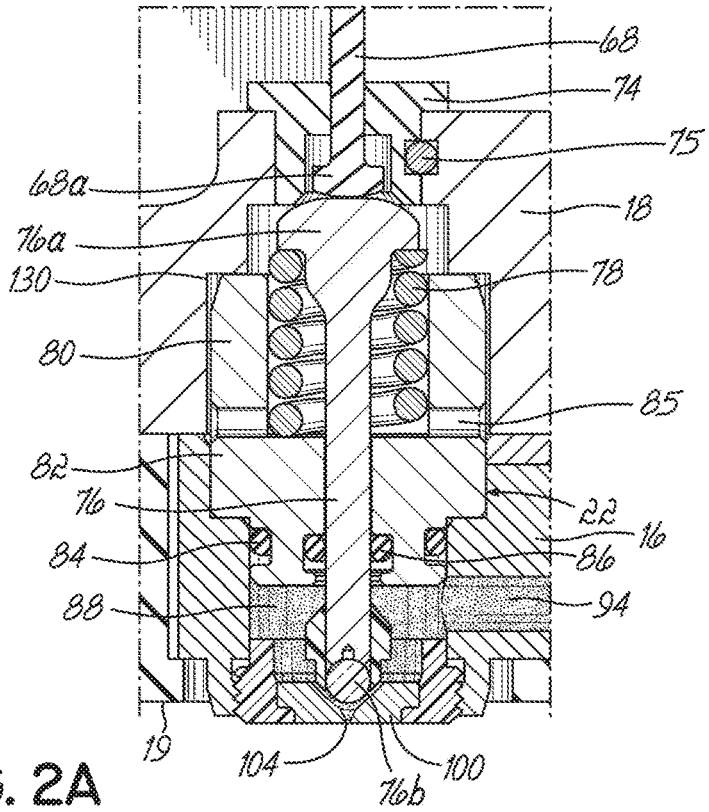
FIG. 2A is an enlarged cross sectional view of the tappet assembly and fluid body taken from FIG. 2, and showing the tappet in an open condition.
Figure 2B:
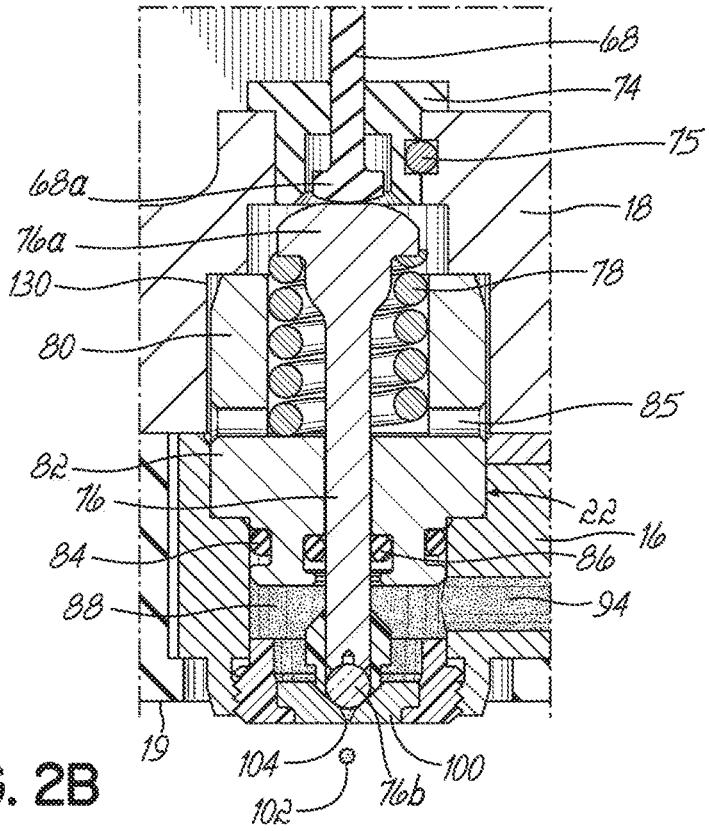
FIG. 2B is a cross sectional view similar to FIG. 2A, but showing the tappet in a closed position after jetting a droplet of fluid.

The second end 24*b* of the lever 24 is fixed to the push rod 68 using suitable threaded fasteners 70, 72. The push rod 68 has a lower head portion 68*a* that travels within a guide bushing 74 and bears against an upper head portion 76*a* of a tappet or valve element 76 associated with the tappet or valve assembly 22. The guide bushing 74 is held in the housing 18 with a pin 75 as best seen in FIGS. 2A and 2B. The assembly of the push rod 68, guide bushing 74 and pin 75 allows for some "give" to ensure proper movement of the push rod 68 during operation. In addition, the push rod 68 is made of a material that will slightly bend sideward, in an elastic manner, during its reciprocating movement with the tappet or valve element 76 and lever 24. The tappet assembly further comprises a coil spring 78 which is mounted within a lower portion of the housing 18 using an annular element 80. The tappet or valve assembly 22 further comprises an insert 82 retained in the fluid body 16 by an O-ring 84. The annular element 80 and the insert 82 comprise an integral element, i.e., a cartridge body in this embodiment. A cross-drilled weep hole 85 is approximately in line with the lower end of the spring 78 to allow any liquid that leaks past the O-ring 86 to escape. An additional O-ring 86 seals the tappet or valve element 76 such that pressurized fluid contained in a fluid bore 88 of the fluid body 16 does not leak out. Fluid is supplied to the fluid bore 88 from the fluid supply 20 through an inlet 90 of the fluid body 16 and passages 92, 94. The O-ring 84 seals the outside of the cartridge body formed by the annular element 80 and insert 82 from the pressurized liquid in bore 88 and passage 94. The fluid passages 92, 94 are sealed by a plug member 96 threaded into the fluid body 16. The plug member 96 may be removed to allow access for cleaning the internal passage 94.

Figure 3:
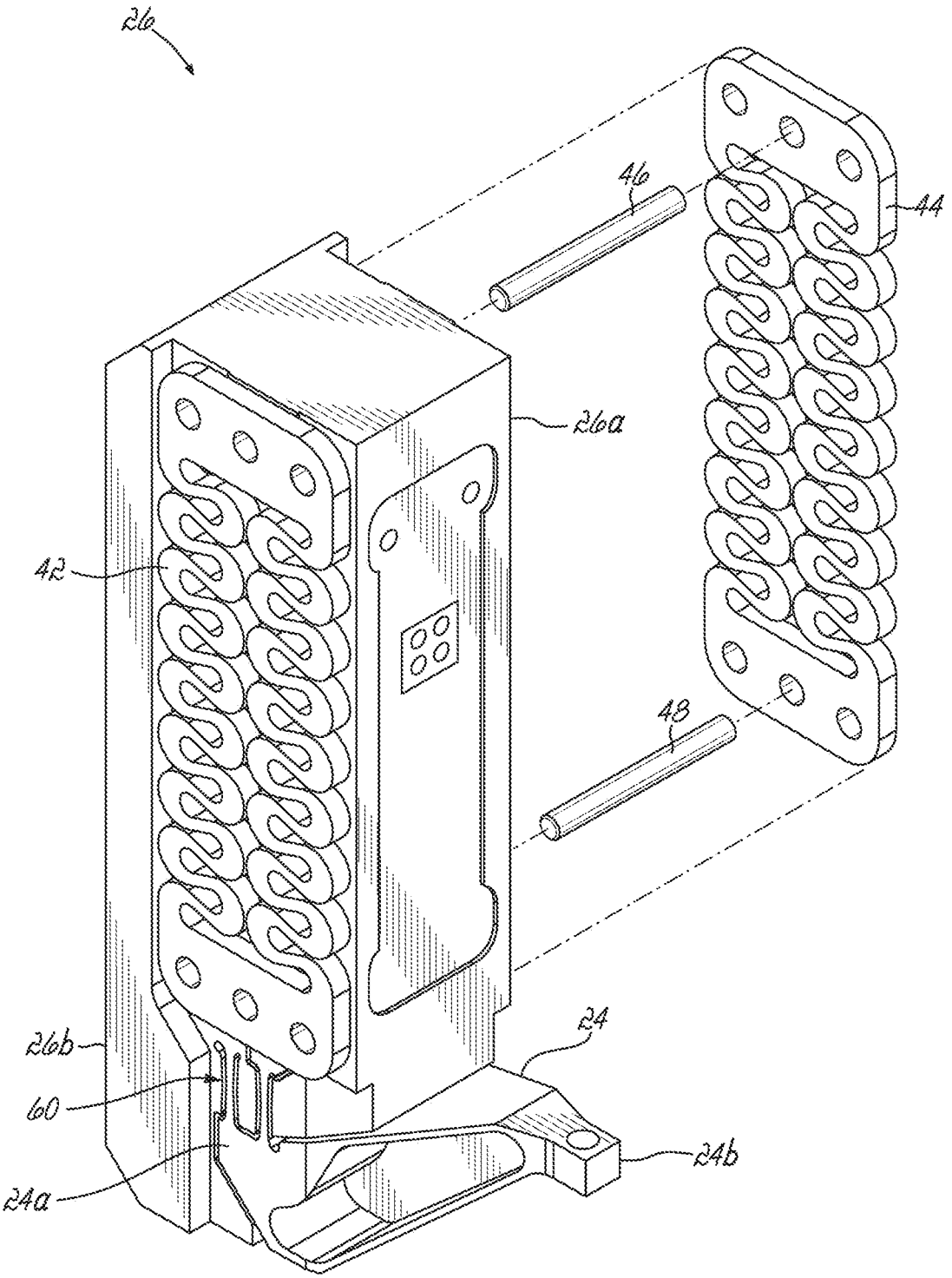
FIG. 3 is a partially exploded perspective view of a piezoelectric actuator of the dispenser.
Figure 4:
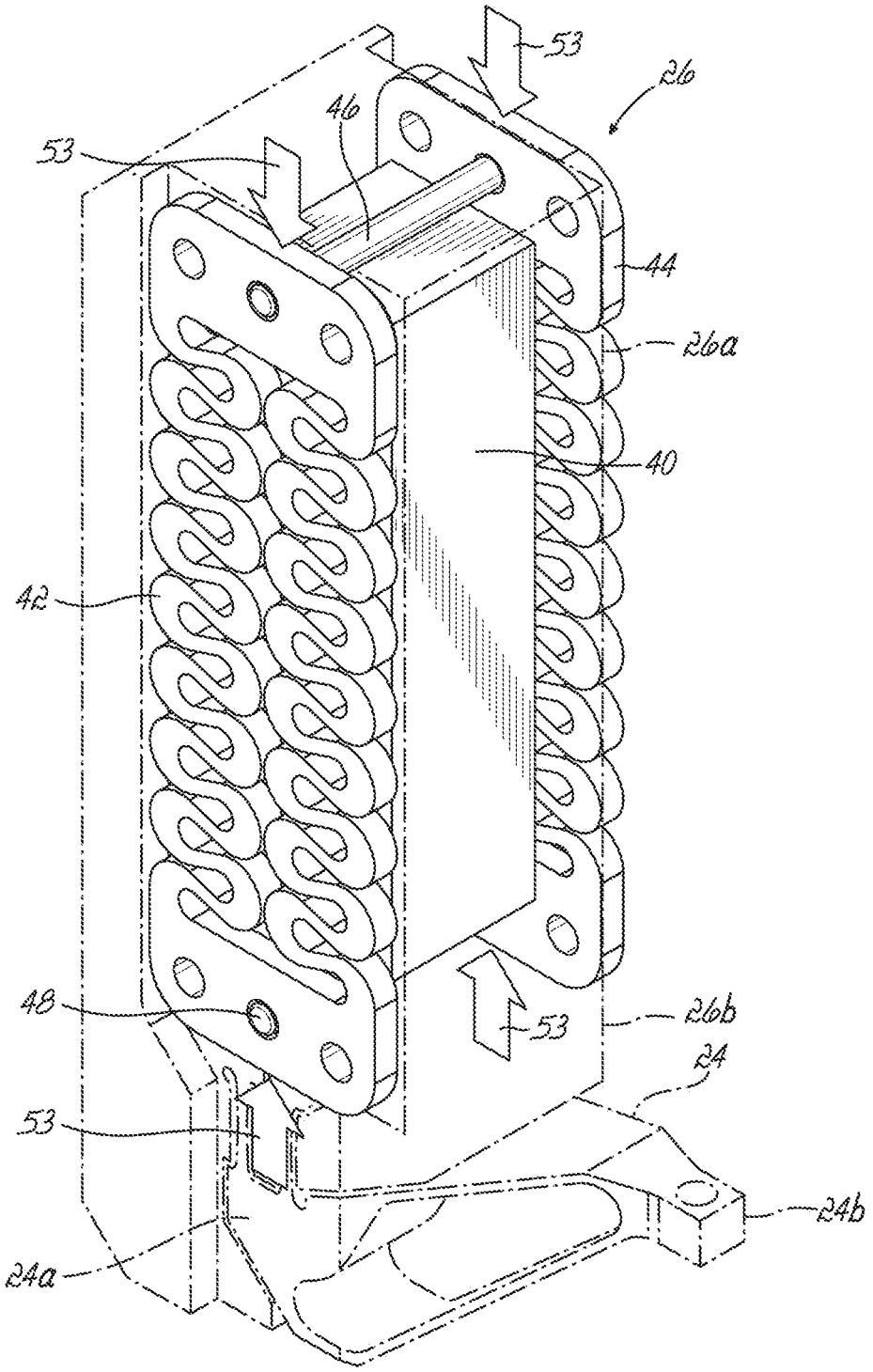
FIG. 4 is a perspective view of the piezoelectric jetting dispenser with certain elements shown in dashed lines to better show inner details.
Figure 5:
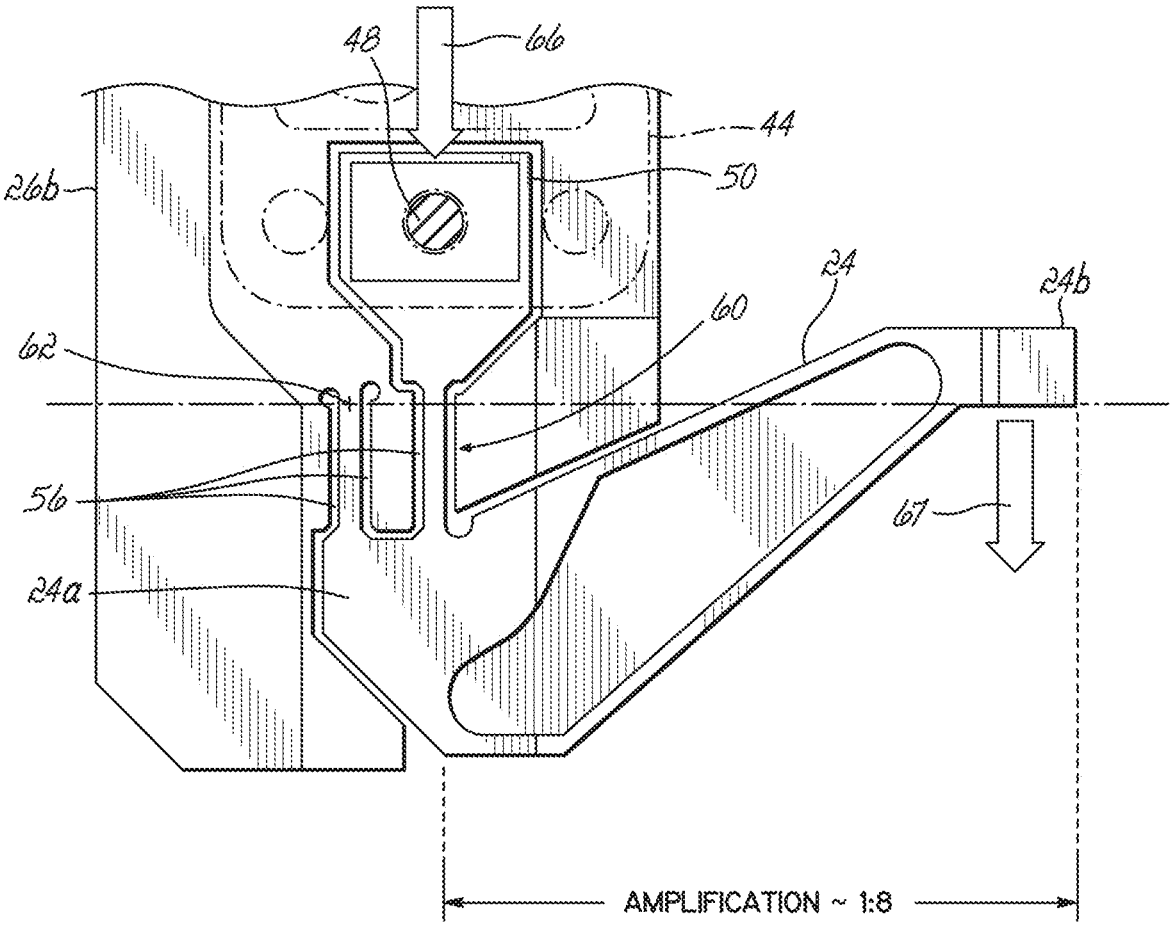
FIG. 5 is a side elevation view of a lower portion of the actuator illustrating a lever amplification mechanism.

The operation of the system 10 to jet droplets or small amounts of fluid will be best understood by reviewing FIGS. 2-4 in conjunction with FIGS. 2A and 2B. FIG. 2A illustrates the tappet or valve element 76 raised to an open condition when the voltage to the piezoelectric stack 40 has been sufficiently removed. This causes the stack 40 to contract. As the stack 40 contracts, the flat spring elements 42, 44 pull the armature 50 upward and this raises the second end 24*b* of the lever 24, and also raises the push rod 68. Thus, the coil spring 78 of the tappet or valve assembly 22 can then push upward on the head portion 76*a* of the tappet or valve element 76 and raise a distal end 76*b* of the tappet or valve element 76 off a valve seat 100 affixed to the fluid body 16. In this position, the fluid bore 88 and the area beneath the distal end 76*b* of the tappet or valve element 76 fills with additional fluid to "charge" the jetting dispenser 12 and prepare the jetting dispenser 12 for the next jetting cycle.

When the piezoelectric stack 40 is activated, i.e., when voltage is applied to the piezoelectric stack 40 by the main electronic control 14 (FIG. 1), the stack 40 expands and pushes against the mechanical armature 50. This rotates the lever 24 clockwise and moves the second end 24*b* downward, also moving the push rod 68 downward. The lower head portion 68*a* of the push rod 68 pushes down on the head 76*a* of the tappet or valve element 76 as shown in FIG. 2B and the tappet or valve element 76 moves quickly downward against the force of the coil spring 78 until the distal end 76*b* engages against the valve seat 100. In the process of movement, the distal end 76*b* of the tappet or valve element 76 forces a droplet 102 of fluid from a discharge outlet 104. Voltage is then removed from the piezoelectric stack 40 and this reverses the movements of each of these components to raise the tappet or valve element 76 for the next jetting cycle.

It will be appreciated that the piezoelectric actuator 26 may be utilized in reverse to jet droplets. In this case, the various mechanical actuation structure including the lever 24 would be designed differently such that when the voltage is removed from the piezoelectric stack 40, the resulting contraction of the stack 40 will cause movement of the tappet or valve element 76 toward the valve seat 100 and the discharge outlet 104 to discharge a droplet 102 of fluid. Then, upon application of the voltage to the stack 40, the amplification system and other actuation components would raise the tappet or valve element 76 in order to charge the fluid bore 88 with additional fluid for the next jetting operation. In this embodiment, the tappet or valve element 76 would be normally closed, that is, it would be engaging the valve seat 100 when there is no voltage applied to the piezoelectric stack 40.

As further shown in FIG. 2, the upper actuator portion 26*a* is separate from the lower actuator portion 26*b* and these respective portions 26*a*, 26*b* are formed from different materials. Specifically, the upper actuator portion 26*a* is formed from a material having a lower coefficient of thermal expansion than the material forming the lower actuator portion 26*b*. Each of the actuator portions 26*a*, 26*b* is securely fastened together using threaded fasteners (not shown) extending from the lower actuator portion 26*b* into the upper actuator portion 26*a*. The assembly of the upper and lower actuator portions 26*a*, 26*b* is then fastened to the housing by a plurality of bolts 110. More specifically, the lower actuator portion 26*b* may be formed from PH17-4 stainless steel, while the upper actuator portion 26*a* may be formed from a nickel-iron alloy, such as Invar. 17-4 PH stainless steel has a very high endurance limit, or fatigue strength, which increases the life of flexural portion 60. The coefficient of thermal expansion of this stainless steel is about 10 μm/m-C, while the coefficient of thermal expansion of Invar is about 1 μm/m-C. The ratio of the thermal expansions may be higher or lower than the approximate 10:1 ratio of these materials. The coefficients of thermal expansion associated with the upper and lower actuator portions 26*a*, 26*b* effectively provide offsetting characteristics to each other. The differing coefficients of thermal expansion of the upper and lower actuator portions 26*a*, 26*b* thereby allow the actuator 26 to operate consistently across a wider temperature range. Also, piezo stacks, when operated at a high duty cycle, can generate significant heat. Use of Invar provides for more absolute positioning of the end of the actuator 26, and hence more accurate and useable stroke.

Figure 6A:
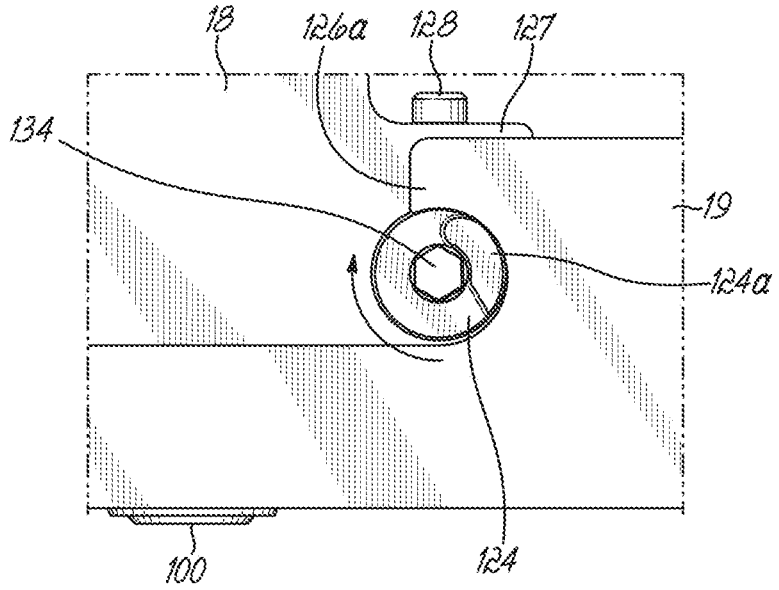
FIG. 6A is an enlarged, schematic view of the fluid body housing coupled to the actuator housing.
Figure 6B:
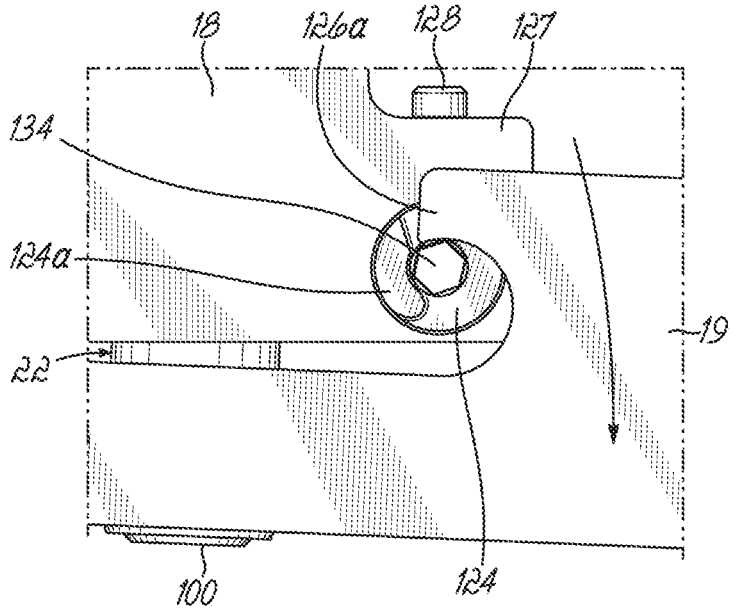
FIG. 6B is a view similar to FIG. 6A, but illustrating the connector being rotated such that the fluid body housing may be decoupled from the actuator housing.
Figure 7:
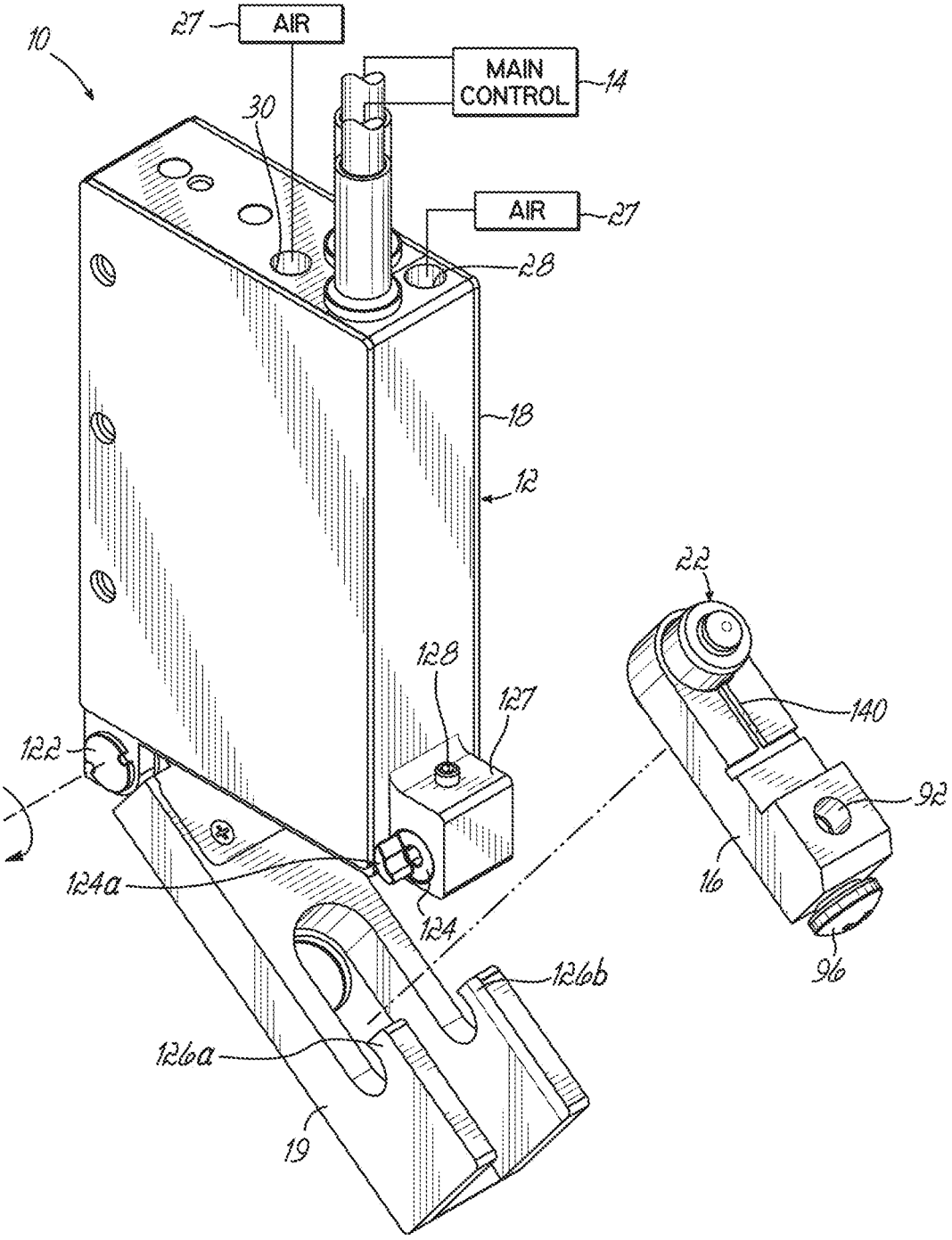
FIG. 7 is a perspective view illustrating the fluid body housing decoupled from the actuator housing and the fluid body being removed.

Referring now to FIGS. 6A, 6B and 7, in conjunction with FIGS. 1 and 2, the fluid body housing 19 serves to retain the fluid body 16 in position as shown in FIG. 2. In this regard, FIGS. 2 and 6A illustrate the fluid body housing 19 coupled to the actuator housing 18 by a hinge 122 at one end and by a rotatable connector 124*a* proximate to an opposite end. The rotatable connector 124*a* connects and disconnects with a hook-shaped flange 126*a* on the fluid body housing 19. The rotatable connector 124*a* is part of a rotating shaft 124 or cam-lock that extends within a connector housing 127. The rotating shaft 124 has an identical connector (not shown) on an opposite end that engages and disengages another hook-shaped flange 126*b* when the rotating shaft 124 is rotated, as will be discussed below. To lock the rotating shaft 124 in an engaged or locked position, a set screw 128 is threaded into frictional engagement with a groove 129 (FIG. 2). The groove 129 maintains the axial position of the rotating shaft 124. The connector housing 127 is rigidly affixed to the actuator housing 18. When the fluid body 16 is secured by the fluid body housing 19, the tappet or valve assembly 22 is retained as shown in a bore 130 of the actuator housing 18 (FIGS. 2A and 2B). Additional passages 131, 132, 133 are provided in the actuator housing 18 and the fluid body housing 19, for example, to allow for the provision of wiring, one or more temperature sensors and one or more heaters, (not shown). One or more heating elements (not shown) may be located directly within the fluid body housing 19 for purposes of heating fluid therein. These heating elements will not need to be removed or otherwise handled when the fluid body housing 19 is decoupled from the actuator housing 18 for maintenance and/or other service.

As shown in FIGS. 6A and 6B, the rotating shaft 124 may be rotated between a position in which the fluid body housing 19 is securely retained against the actuator housing 18 (FIG. 6A), and a position in which the fluid body housing 19 may be rotated downwardly about the hinge 122 (FIG. 7) to decouple the fluid body housing 19. To rotate the shaft between the positions shown in FIGS. 6A and 6B, a tool (not shown) is engaged with the hex-shaped bore 134. Once decoupled, the fluid body 16 may be removed from the fluid body housing 19 as further shown in FIG. 7. The upper surface of the fluid body housing 19 includes a T-shaped groove 140 that provides a path for any fluid leakage or overpressure condition. Fluid leaking past the O-rings 84 and/or 86 will be able to vent out of the T-shaped groove 140 (FIG. 2). As shown best in FIGS. 2 and 7, removal of the fluid body 16 will allow easier cleaning and/or other maintenance or replacement of components before the fluid body 16 is re-inserted within the fluid body housing 19. In this regard, the tappet or valve assembly 22 also may be easily removed from the fluid body 16 and replaced with one or more new parts and/or cleaned for re-use. Also, the passages 92, 94 may be easily cleaned. The passage 92 can be easily cleaned when the fluid body 16 is removed, while the passage 94 is easily cleaned when the plug member 96 is removed.

Figure 8:
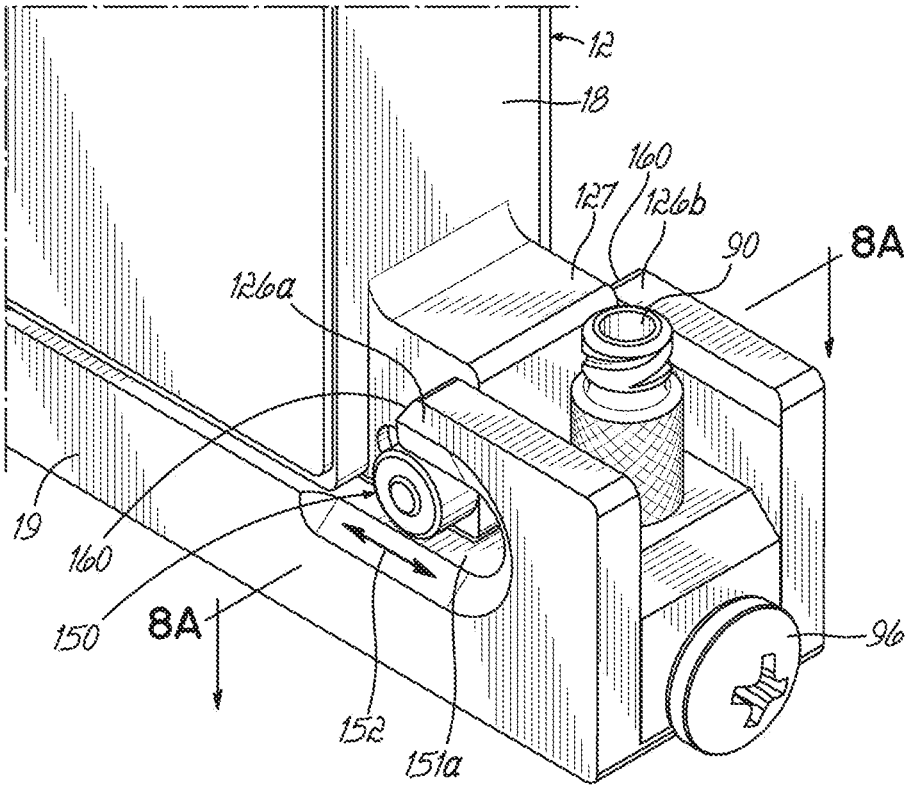
FIG. 8 is a perspective view illustrating an alternative embodiment for a connector allowing coupling and decoupling of the fluid body housing with respect to the actuator housing.
Figure 8A:
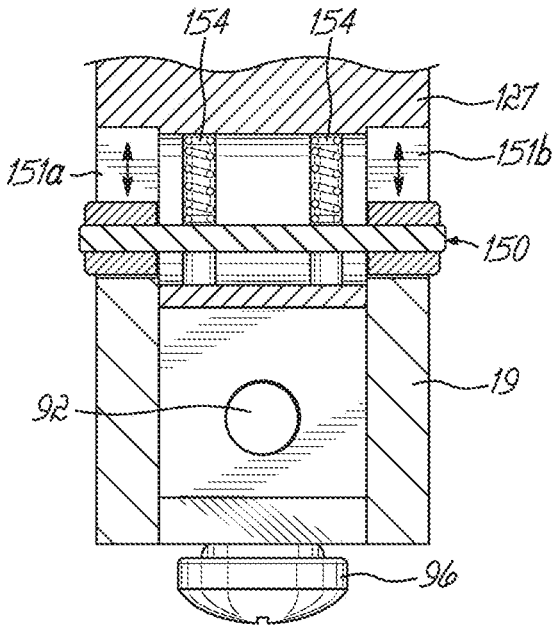
FIG. 8A is a cross sectional view taken along line 8A-8A of FIG. 8.

FIGS. 8 and 8A illustrate an alternative embodiment for a connector used to couple the fluid body housing 19 to the actuator housing 18. In this embodiment, a movable pin 150 is coupled to the connector housing 127 of the actuator housing 18. This pin 150 can move back and forth within a pair of slots 151*a*, 151*b* in the directions of the double headed arrow 152 of FIG. 8 against the bias of a pair of springs 154 (FIG. 8A). Thus, the pin 150 is moved toward the actuator housing 18 against the bias of the springs 154, and out from the slots 151*a*, 151*b* in order to allow the fluid body housing 19 to pivot downwardly for decoupling the fluid body housing 19 from the actuator housing 18 and allowing maintenance and/or replacement of the fluid body 16 as discussed above. When the fluid body 16 is replaced in the fluid body housing 19, the assembly of the fluid body 16 and the fluid body housing 19 is then rotated upwardly and the cam surfaces 160 of the fluid body housing 19 force the pin 150 toward the actuator housing 18 against the bias of the springs 154. When the fluid body housing 19 reaches the position shown in FIG. 8, the spring-biased pin 150 springs away from the actuator housing 18 due to the bias force of the springs 154 and snaps into the slots 151*a*, 151*b*. This locks the fluid body 16 in the position shown in FIG. 2 for purposes of operation as a jetting dispenser.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A fluid dispenser, comprising:

an actuator housing and an electric actuator responsive to an electronic control disposed in the actuator housing:

a fluid body housing coupled to the actuator housing at one end and releasably coupled to the actuator housing at another end, such that the fluid body housing is pivotable between a first position in which the fluid body housing is coupled to the actuator housing at both ends and a second position in which the fluid body housing is decoupled from the actuator housing at the another end; and a fluid body comprising a fluid inlet and a dispensing valve, the fluid body being at least partly retained in the fluid body housing when the fluid body housing is in the first position and being removable from the fluid body housing when the fluid body housing is in the second position, wherein the dispensing valve is a jetting valve comprising:

a movable shaft operatively coupled with the electric actuator when the fluid body housing is in the first position; and a valve seat, a distal end of the movable shaft being configured to engage against the valve seat to discharge a droplet of fluid onto a substrate, wherein the actuator housing comprises a push rod operatively coupled with the electric actuator, and when the fluid body housing is in the first position, the electric actuator is configured to move the push rod into engagement with the movable shaft to discharge the droplet of the fluid;

wherein the fluid inlet is configured to receive the fluid under pressure from a fluid supply; and wherein the fluid body housing is configured to pivot with respect to the electric actuator while holding the fluid body and the fluid inlet.

2. The fluid dispenser of claim 1, wherein the jetting valve further comprises a fluid bore to provide the fluid to the valve seat, the fluid bore being fluid bore being in fluid communication with the fluid inlet; and wherein the electric actuator comprises a piezoelectric actuator that operates in response to an applied voltage.

3. The fluid dispenser of claim 2, wherein the fluid body further comprises a plug configured to seal the fluid bore and the plug further configured to be removed from the fluid bore to facilitate cleaning of the fluid bore.

4. The fluid dispenser of claim 1, wherein the fluid body housing is rotatably coupled to the actuator housing at the one end by a hinge; and wherein the fluid body housing is configured to pivot with respect to the electric actuator while holding the fluid body, the jetting valve, the fluid inlet, and the valve seat.

5. The fluid dispenser of claim 4, wherein the fluid body housing is configured to pivot between the first position and the second position by rotating the fluid body housing about the hinge.

6. The fluid dispenser of claim 5, wherein the fluid body housing is rotated downwardly about the hinge to pivot from the first position to the second position.

7. The fluid dispenser of claim 1, wherein the fluid body housing is releasably coupled to the actuator housing at the another end with a rotating connector; and wherein the fluid body housing is configured to pivot with respect to the electric actuator while holding the fluid body, the jetting valve, the fluid inlet, and the valve seat.

8. The fluid dispenser of claim 7, wherein the fluid body housing comprises a hook flange at the another end, the hook flange being configured to engage the rotating connector to releasably couple the fluid body housing with the actuator housing at the another end.

9. The fluid dispenser of claim 7, further comprising a connector housing affixed to the actuator housing, wherein the rotating connector is situated within the connector housing.

10. The fluid dispenser of claim 1, wherein the fluid body housing is releasably coupled to the actuator housing at the other end with a movable pin.

11. The fluid dispenser of claim 10, wherein the movable pin couples the fluid body housing to the actuator housing by moving within a slot in the fluid body housing.

12. The fluid dispenser of claim 10, further comprising a connector housing affixed to the actuator housing.

13. The fluid dispenser of claim 12, wherein the connector housing comprises a spring-biasing element, the movable pin being moved against the spring-biasing element toward the actuator housing to releasably couple the fluid body housing to the actuator housing at the other end.

14. The fluid dispenser of claim 1, wherein the electric actuator is a piezoelectric actuator that lengthens by a first distance in response to an applied voltage; and wherein the fluid body housing is configured to operatively couple the fluid body to the electric actuator when the fluid body housing is in the first position and the fluid body housing is configured to operatively decouple the fluid body from the electric actuator when the fluid body housing is in the second position.

15. A fluid dispenser, comprising:

an actuator housing comprising an electric actuator responsive to an electronic control;

a fluid body housing coupled to the actuator housing at one end and releasably coupled to the actuator housing at another end, such that the fluid body housing is pivotable between a first position in which the fluid body housing is coupled to the actuator housing at both ends and a second position in which the fluid body housing is decoupled from the actuator housing at the another end; and a fluid body comprising a fluid inlet and a dispensing valve, the fluid body being at least partly retained in the fluid body housing when the fluid body housing is in the first position and being removable from the fluid body housing when the fluid body housing is in the second position, wherein the fluid body is unsecured to the electric actuator when the fluid body housing is in the second position, movement of the fluid body housing to the first position secures the fluid body to the electric actuator such that the dispensing valve is positioned to be actuated by the electric actuator; and wherein the dispensing valve is a jetting valve comprising:

a movable shaft operatively coupled with the electric actuator when the fluid body housing is in the first position; and a valve seat, a distal end of the movable shaft being configured to engage against the valve seat to discharge a droplet of fluid onto a substrate, wherein the fluid body housing is configured to pivot with respect to the electric actuator while holding the fluid body, the jetting valve, the fluid inlet, and the valve seat.

16. A fluid dispenser, comprising:

an actuator housing comprising an electric actuator responsive to an electronic control;

a fluid body housing coupled to the actuator housing at one end and releasably coupled to the actuator housing at another end, such that the fluid body housing is pivotable between a first position in which the fluid body housing is coupled to the actuator housing at both ends and a second position in which the fluid body housing is decoupled from the actuator housing at the another end; and a fluid body comprising a fluid inlet and a dispensing valve, the fluid body being at least partly retained in the fluid body housing when the fluid body housing is in the first position and being removable from the fluid body housing when the fluid body housing is in the second position, wherein the fluid body is unsecured to the electric actuator when the fluid body housing is in the second position, movement of the fluid body housing to the first position secures the fluid body to the electric actuator such that the dispensing valve is positioned to be actuated by the electric actuator; and wherein the dispensing valve is a jetting valve comprising:

a movable shaft operatively coupled with the electric actuator when the fluid body housing is in the first position; and a valve seat, a distal end of the movable shaft being configured to engage against the valve seat to discharge a droplet of fluid onto a substrate, wherein the actuator housing comprises an actuator housing defining a void that houses the electric actuator; and wherein the fluid body housing is configured to pivot with respect to the actuator housing and the electric actuator while holding the fluid body and the fluid inlet.

17. A fluid dispenser, comprising:

an actuator housing and an electric actuator responsive to an electronic control disposed in the actuator housing:

a fluid body housing coupled to the actuator housing at one end and releasably coupled to the actuator housing at another end, such that the fluid body housing is pivotable between a first position in which the fluid body housing is coupled to the actuator housing at both ends and a second position in which the fluid body housing is decoupled from the actuator housing at the another end; and a fluid body comprising a fluid inlet and a dispensing valve, the fluid body being at least partly retained in the fluid body housing when the fluid body housing is in the first position and being removable from the fluid body housing when the fluid body housing is in the second position, wherein the dispensing valve is a jetting valve comprising:

a movable shaft operatively coupled with the electric actuator when the fluid body housing is in the first position; and a valve seat, a distal end of the movable shaft being configured to engage against the valve seat to discharge a droplet of fluid onto a substrate, wherein the actuator housing comprises a push rod operatively coupled with the electric actuator, and when the fluid body housing is in the first position the electric actuator is configured to move the push rod into engagement with the movable shaft to discharge the droplet of the fluid, wherein the fluid body housing is configured to pivot with respect to the electric actuator while holding the fluid body, the jetting valve, the fluid inlet, and the valve seat.

* * * * *